US010825416B2

(12) United States Patent
Pyun et al.

(10) Patent No.: US 10,825,416 B2
(45) Date of Patent: Nov. 3, 2020

(54) INTERFACE SYSTEM AND DISPLAY DEVICE INCLUDING THE SAME

(71) Applicant: Samsung Display Co., Ltd., Yongin-si, Gyeonggi-do (KR)

(72) Inventors: Ki Hyun Pyun, Yongin-si (KR); Jong Young Yun, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/401,088

(22) Filed: May 1, 2019

(65) Prior Publication Data

US 2019/0392778 A1 Dec. 26, 2019

(30) Foreign Application Priority Data

Jun. 21, 2018 (KR) ..... 10-2018-0071511

(51) Int. Cl.
*G09G 3/30* (2006.01)
*G09G 3/36* (2006.01)
*G09G 3/3275* (2016.01)

(52) U.S. Cl.
CPC ..... *G09G 3/3688* (2013.01); *G09G 3/3275* (2013.01); *G09G 2310/08* (2013.01)

(58) Field of Classification Search
CPC ..... G09G 2370/08; G09G 2310/0264–0297; G09G 3/3611–3696
See application file for complete search history.

(56) References Cited

U.S. PATENT DOCUMENTS 6,570,934 B1 5/2003 Harada
8,693,557 B1 * 4/2014 Zhang ..... H04L 25/0266 375/259
2013/0009917 A1 * 1/2013 Hsu ..... G09G 3/3614 345/204
2013/0088531 A1 * 4/2013 Su ..... G09G 3/3611 345/691
2016/0020824 A1 * 1/2016 Ulrich ..... G06F 17/10 375/340
2018/0054109 A1 2/2018 Zhang et al.
2018/0062762 A1 3/2018 Mun et al.

FOREIGN PATENT DOCUMENTS

KR 10-0309233 B1 11/2001

* cited by examiner

*Primary Examiner* — Sanghyuk Park
(74) *Attorney, Agent, or Firm* — Lewis Roca Rothgerber Christie LLP

(57) ABSTRACT

An interface system may include a transmitter and a receiver, which are coupled to each other through transmission lines, wherein the transmitter includes a transmission controller configured to transmit a reset signal to the receiver, wherein the receiver includes a reset unit configured to reset input common mode voltages of the transmission lines, based on the reset signal, and wherein the transmission lines include a first transmission line for transmitting a signal having a first phase, and a second transmission line for transmitting a signal having a second phase that is different from the first phase.

19 Claims, 8 Drawing Sheets

INTERFACE SYSTEM AND DISPLAY DEVICE INCLUDING THE SAME

CROSS-REFERENCE TO RELATED APPLICATION

This application claims priority to, and the benefit of, Korean patent application 10-2018-0071511 filed on Jun. 21, 2018 in the Korean Intellectual Property Office, the entire disclosure of which is incorporated herein by reference.

BACKGROUND

1. Field

The present disclosure generally relates to an interface system, and to a display device including the same.

2. Related Art

With the development of information technologies, the importance of a display device, which is a connection medium between a user and information, increases. Accordingly, display devices, such as a liquid crystal display device, a plasma display device, and an organic light emitting display device, are increasingly used.

In general, a display device includes a plurality of pixels, a data driving integrated circuit (DDI) for driving the plurality of pixels, and a timing controller (TCON) for controlling the DDI.

The plurality of pixels may emit lights with luminances corresponding to data signals supplied thereto, and the DDI may supply data signals to the plurality of pixels. The TCON may transmit data signals, a synchronization signal, a protocol signal, and the like to the DDI. The TCON and the DDI may communicate with each other through an interface system. For example, a universal serial interface (USI) module or USI-T module may be used as the interface system in the display device.

The interface system includes a transmitter (TX) and a receiver (RX). The TX and RX may stably communicate with each other under a condition in which an input common mode voltage (VICM) and an input differential voltage (VID) correspond to each other.

Further, an AC coupling capacitor for reducing or minimizing a DC component of a signal is coupled to a transmission line, so that VICMs of the TX and the RX can be tuned to each other.

SUMMARY

Embodiments described herein provide an interface system capable of improving communication performance by periodically resetting an input common mode voltage of a transmitter or receiver, and a display device including the interface system.

According to an aspect of the present disclosure, there is provided an interface system including a transmitter and a receiver, which are coupled to each other through transmission lines, wherein the transmitter includes a transmission controller configured to transmit a reset signal to the receiver, wherein the receiver includes a reset unit configured to reset input common mode voltages of the transmission lines, based on the reset signal, and wherein the transmission lines include a first transmission line for transmitting a signal having a first phase, and a second transmission line for transmitting a signal having a second phase that is different from the first phase.

The reset unit may include a first reference switch and a second reference switch, which are configured to be turned on when the reset signal is supplied, wherein the first reference switch is coupled between a reference power source and the first transmission line, and wherein the second reference switch is coupled between the reference power source and the second transmission line.

The reference power source may have a ground voltage.

The reset unit may include a bias voltage supply unit coupled between a driving power source and a first driving switch, and coupled between the driving power source and a second driving switch, the first and second driving switches being configured to be turned on when the reset signal is not supplied, wherein the first driving switch is coupled between the bias voltage supply unit and the first transmission line, and wherein the second driving switch is coupled between the bias voltage supply unit and the second transmission line.

Each of the first transmission line and the second transmission line may include a coupling capacitor.

The first phase and the second phase may be opposite to each other.

The transmission controller may be configured to periodically transmit the reset signal to the receiver according to a reset period.

The transmitter may further include a signal transmitter configured to transmit a data signal having a white pattern or a black pattern to the receiver when the transmitter is powered on, and the transmission controller may be configured to transmit a lock start signal to the receiver while the data signal is being transmitted.

The receiver further may include a clock data recovery (CDR) circuit configured to transmit a lock fail signal to the transmitter when a balance fail occurs corresponding to the data signal.

The transmitter may further include a balance fail detector configured to generate a balance fail signal based on the lock start signal and the lock fail signal.

The transmission controller may be configured to measure a balance fail time representing a time for which the balance fail signal is supplied.

The transmission controller may be configured to set, to the reset period, a value obtained by dividing K (K is a natural number larger than 1) into the balance fail time.

According to another aspect of the present disclosure, there is provided a display device including a display unit including pixels arranged at crossing regions of scan lines and data lines, a data driver configured to supply data signals to the data lines, and a timing controller configured to communicate with the data driver through an interface system, wherein the interface system includes a transmitter and a receiver, which are coupled to each other through transmission lines, wherein the transmitter includes a transmission controller configured to transmit a reset signal to the receiver, wherein the receiver includes a reset unit configured to reset input common mode voltages of the transmission lines based on the reset signal, and wherein the transmission lines include a first transmission line for transmitting a signal having a first phase, and a second transmission line for transmitting a signal having a second phase that is different from the first phase.

The reset unit may include a first reference switch and a second reference switch, which are configured to be turned on when the reset signal is supplied, wherein the first reference switch is coupled between a reference power source and the first transmission line, and wherein the second reference switch is coupled between the reference power source and the second transmission line.

The reset unit may further include a bias voltage supply unit coupled between a driving power source and a first driving switch, and coupled between the driving power source and a second driving switch, the first and second driving switches being configured to be turned on when the reset signal is not supplied, wherein the first driving switch is coupled between the bias voltage supply unit and the first transmission line, and wherein the second driving switch is coupled between the bias voltage supply unit and the second transmission line.

The transmission controller may be configured to periodically transmit the reset signal to the receiver according to a reset period.

The transmitter may further include a signal transmitter configured to transmit a data signal having a white pattern or a black pattern to the receiver when the transmitter is powered on, and the transmission controller may be configured to transmit a lock start signal to the receiver while the data signal is being transmitted.

The receiver may further include a CDR circuit configured to transmit a lock fail signal to the transmitter when a balance fail occurs corresponding to the data signal.

The transmitter may further include a balance fail detector configured to generate a balance fail signal based on the lock start signal and the lock fail signal, and the transmission controller may be configured to measure a balance fail time representing a time for which the balance fail signal is supplied, and is configured to set the reset period based on the balance fail time.

In the interface system and the display device including the same according to embodiments of the present disclosure, the input common mode voltage of the transmitter or the receiver is periodically reset, so that communication performance can be improved.

BRIEF DESCRIPTION OF THE DRAWINGS

Embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
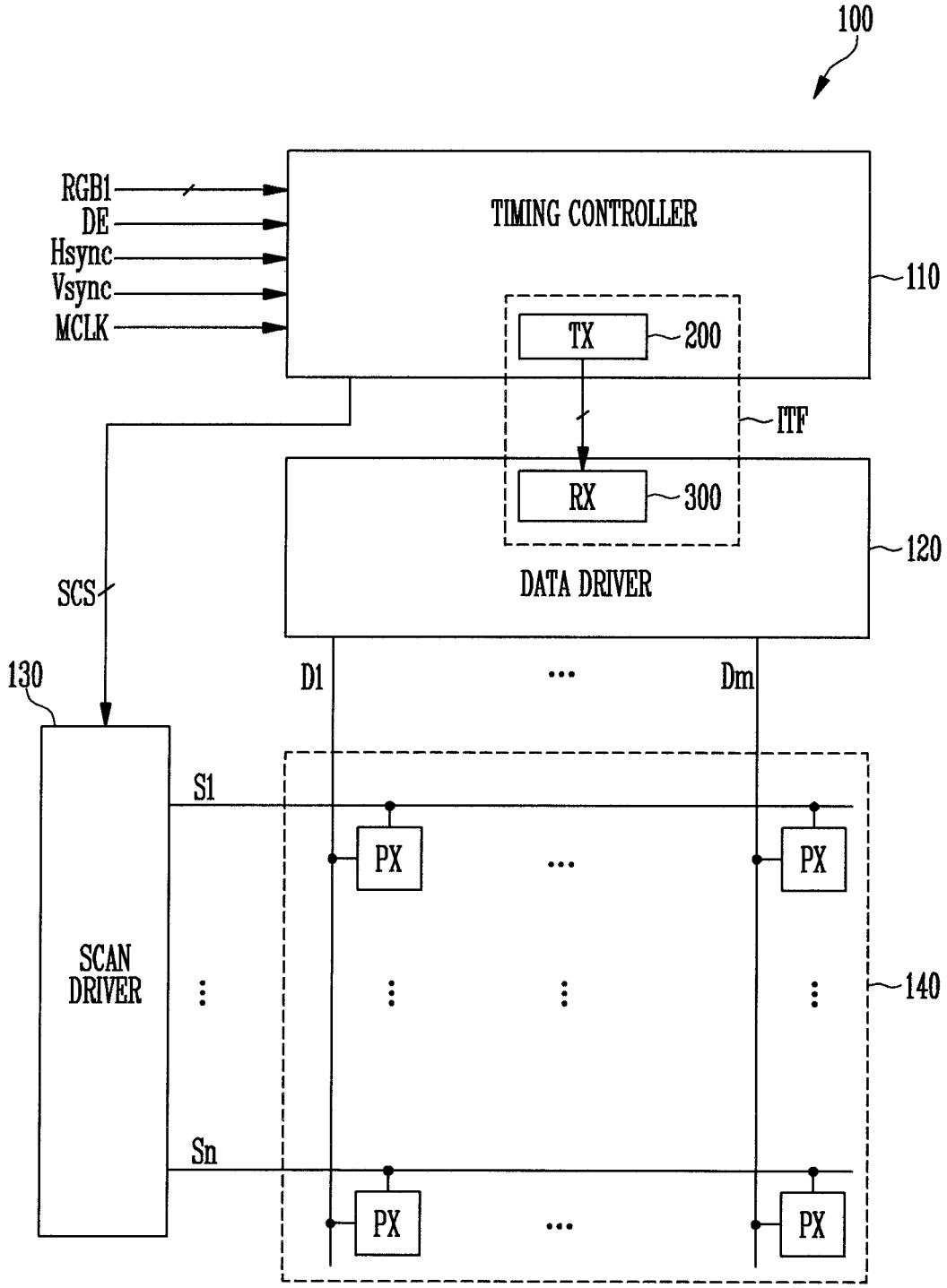
FIG. 1 is a diagram illustrating a display device according to an embodiment of the present disclosure.

In the following detailed description, only certain embodiments of the present disclosure have been shown and described, simply by way of illustration. As those skilled in the art would realize, the described embodiments may be modified in various different ways, all without departing from the spirit or scope of the present disclosure. Accordingly, the drawings and description are to be regarded as illustrative in nature and not restrictive.

It will be understood that, although the terms "first," "second," etc. may be used herein to describe one or more elements, these terms should not be construed as limiting such elements. These terms are only used to distinguish one element from another element. Thus, a first element could be alternately termed a second element without departing from the spirit and scope of the present disclosure. Similarly, a second element could be alternately termed a first element. Singular forms of terms are intended to include the plural forms as well, unless the context clearly indicates otherwise.

Moreover, spatially relative terms, such as "beneath," "below," "lower," "above," "upper," and the like may be used herein for ease of description to describe one element's spatial relationship to another element(s) as illustrated in the drawings. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be further understood that the terms "includes" and "including," when used in this disclosure, specify the presence of stated features, integers, acts, operations, elements, and/or components, but do not preclude the presence or addition of one or more other features, integers, steps, operations, elements, components, and/or groups thereof.

In the entire specification, when an element is referred to as being "connected" or "coupled" to another element, it can be directly connected or coupled to the another element or be indirectly connected or coupled to the another element with one or more intervening elements interposed therebetween. Further, some of the elements that are not essential to the complete understanding of the disclosure are omitted for clarity.

Also, like reference numerals refer to like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity. The thicknesses, ratios, and dimensions of elements may be exaggerated in the drawings for clarity. As used herein, the term "and/or" includes any and all combinations of one or more of the associated listed items.

FIG. 1 is a diagram illustrating a display device 100 according to an embodiment of the present disclosure.

Referring to FIG. 1, the display device 100 may include a timing controller 110, a data driver 120, an interface system ITF, a scan driver 130, and a display unit 140.

The timing controller 110 may control overall operations of the display device 100. The timing controller 110 may receive image data RGB1 and external control signals from the outside. For example, external control signals may include a vertical synchronization signal Vsync, a horizontal synchronization signal Hsync, a main clock signal MCLK, a data enable signal DE, and the like.

The timing controller 110 may process the image data RGB1 and the external control signals to satisfy operating conditions of the data driver 120, the scan driver 130, and the display unit 140, and may generate the processed image data, a clock signal, and the like.

The timing controller 110 may include a transmitter TX 200 of the interface system ITF. The timing controller 110 may communicate with the data driver 120 through the interface system ITF. For example, the timing controller 110 may transmit the processed image data, the clock signal, and the like to the data driver 120 through the interface system ITF.

The timing controller 110 may output a scan driver control signal SCS to the scan driver 130. For example, the scan driver control signal SCS may include a scan start signal, a plurality of clock signals, and the like.

In some embodiments, the interface system ITF may be implemented with a USI module, a USI-T module, etc.

The data driver 120 may include a receiver RX 300 of the interface system ITF. For example, the transmitter TX 200 and the receiver RX 300 may be coupled to each other through transmission lines. The data driver 120 may receive the processed image data, the clock signal, and the like from the timing controller 110 through the interface system ITF.

The data driver 120 may supply data signals to data lines D1 to Dm (m is a natural number of 1 or more) based on the processed image data, the clock signal, and the like. For example, the data driver 120 may supply data signals to the data lines D1 to Dm such that the data signals are synchronized with a corresponding scan signal.

For example, the receiver RX may include a clock data recovery (CDR) circuit, an equalizer, and the like, which will be described in detail later.

Hereinafter, for convenience of description, the data driver 120 may mean a data driving IC.

The scan driver 130 may receive the scan control signal SCS. The scan driver 130 may supply scan signals to scan lines S1 to Sn (n is a natural number of 1 or more) based on the scan control signal SCS. For example, the scan driver 130 may sequentially supply scan signals to the scan lines S1 to Sn.

The display unit 140 may include pixels PX arranged on the substrate. For example, the display unit 140 may mean a display area of a display panel.

The pixels PX may be respectively coupled to corresponding data lines D1 to Dm and corresponding scan lines S1 to Sn, and may be supplied with data signals and scan signals through the data lines D1 to Dm and the scan lines S1 to Sn. The pixels PX may be arranged at crossing regions of the scan lines S1 to Sn and the data lines D1 to Dm. The pixels PX may emit lights with luminances corresponding to the data signals.

The display unit 140 may further include the scan lines S1 to Sn and the data lines D1 to Dm. In some embodiments, the scan lines S1 to Sn may extend in a first direction (e.g., a horizontal direction), and the data lines D1 to Dm may extend in a second direction (e.g., a vertical direction) that is different from the first direction.

In some embodiments, any one of the pixels PX may be coupled to at least one of the scan lines S1 to Sn and at least one of the data lines D1 to Dm. Each of the pixels PX may include a first transistor (e.g., a switching transistor) coupled to a corresponding scan line and to a corresponding data line, a second transistor (e.g., a driving transistor) coupled to the first transistor, and a light emitting device. Hereinafter, a case where the light emitting device is an organic light emitting diode is described for convenience of description. However, the present disclosure is not limited thereto.

A first electrode of the first transistor may be coupled to any one of the data lines D1 to Dm, and a second electrode of the first transistor may be coupled to the second transistor. In addition, a gate electrode of the first transistor may be coupled to any one of the scan lines S1 to Sn.

A first electrode of the second transistor may be coupled to a first power source, and a second electrode of the second transistor may be coupled to an anode electrode of the light emitting device. In addition, a gate electrode of the second transistor may be connected to the second electrode of the first transistor.

The anode electrode of the light emitting device may be coupled to the second electrode of the second transistor, and a cathode electrode of the light emitting device may be coupled to a second electrode. The light emitting device may emit light with a corresponding luminance according to a driving current flowing from the first power source to the second power source therethrough.

The second transistor may control the driving current flowing from the first power source to the second power source through the light emitting device according to a data signal transferred through the first transistor.

However, the present disclosure is not limited thereto, and the structure of each of the pixels PX may be varied in some embodiments.

In some embodiments, each of the pixels PX may include a red sub-pixel emitting light of a first color (e.g., red), a green sub-pixel emitting light of a second color (e.g., green), and a blue sub-pixel emitting light of a third color (e.g., blue).

Figure 2:
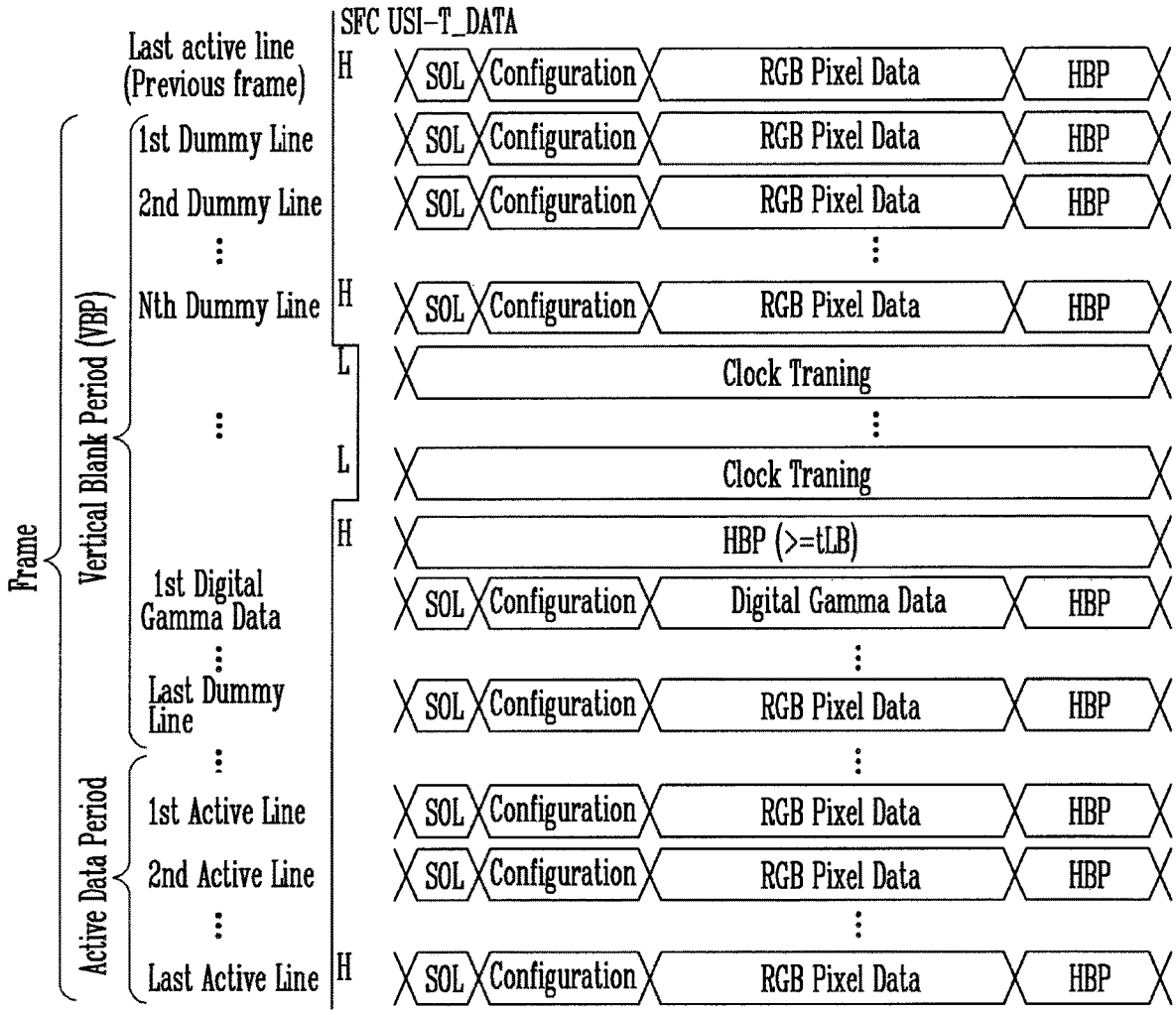
FIG. 2 is a diagram illustrating a configuration of a frame according to an embodiment of the present disclosure.

FIG. 2 is a diagram illustrating a configuration of a frame according to an embodiment of the present disclosure.

Referring to FIGS. 1 and 2, the display device 100 are driven according to consecutive frames, and each frame may include an active data period and a vertical blank period. The active data period and the vertical blank period may be configured in units of horizontal line periods.

In some embodiments, the timing controller 110 may transmit, to the data driver 120, image data in which a clock signal is embedded.

When a frame control signal SFC has a low level, clock signals of the transmitter TX and the receiver RX may be synchronized with each other (e.g., clock training). For example, when the frame control signal SFC has the low level, the CDR circuit of the receiver Rx recovers a reference clock, so that the clock signal of the receiver RX can be synchronized (e.g., phase-locked) with the clock signal of the transmitter TX.

When the frame control signal SFC has a high level, each horizontal line period may be configured with a start of line (SOL) period, a configuration period, an RGB pixel data period, and a horizontal blank period (HBP).

Figure 3:
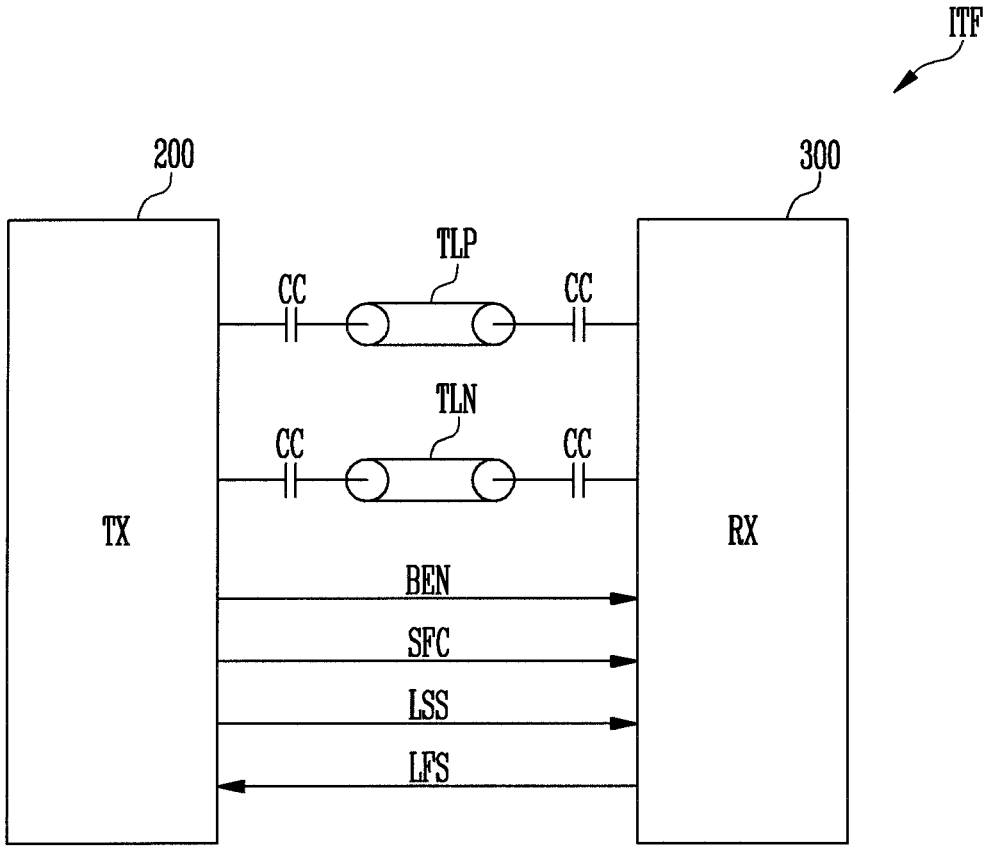
FIG. 3 is a diagram illustrating an interface system according to an embodiment of the present disclosure.
Figure 4A:
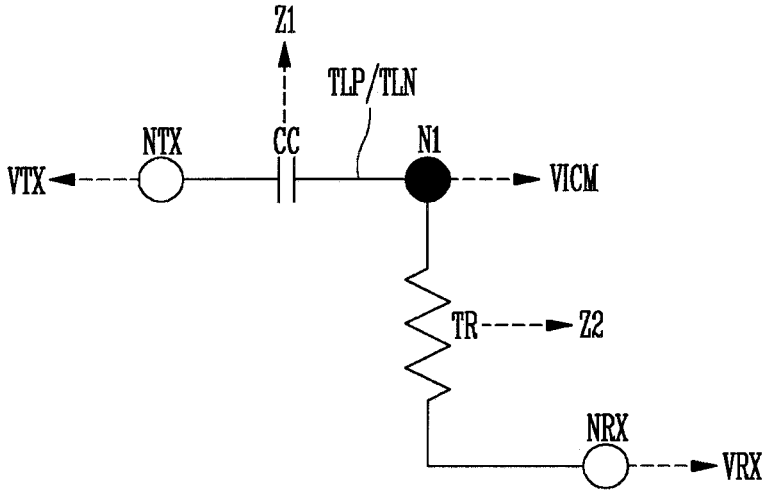
FIGS. 4A and 4B are diagrams illustrating a change in input common mode voltage of the interface system according to an embodiment of the present disclosure.
Figure 4B:
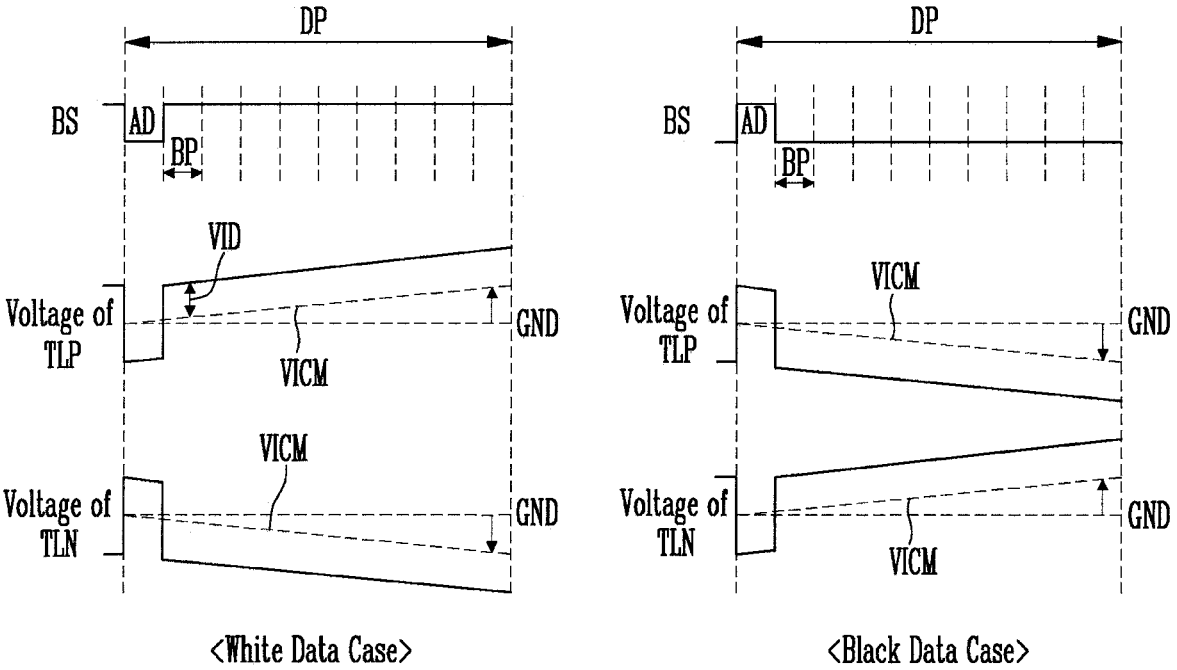

FIG. 3 is a diagram illustrating an interface system ITF according to an embodiment of the present disclosure. FIGS. 4A and 4B are diagrams illustrating a change in input common mode voltage VICM of the interface system according to an embodiment of the present disclosure. In some embodiments, the interface system ITF may be a USI-T interface module.

Referring to FIG. 3, the interface system ITF may include a transmitter TX and a receiver RX, which are coupled to each other through transmission lines.

In some embodiments, the transmitter TX may be included in the timing controller 110 (see FIG. 1), and the receiver RX may be included in the data driver 120 (see FIG. 1). The transmitter TX may communicate with the receiver RX in a differential signal manner. That is, the transmission lines may include a first transmission line TLP for transmitting a signal having a first phase, and may include a second transmission line TLN for transmitting a signal having a second phase. The transmitter TX may transmit a data signal through the first transmission line TLP and the second transmission line TLN. In some embodiments, the first phase and the second phase may be opposite to each other.

Each of the first transmission line TLP and the second transmission line TLN may include at least one coupling capacitor. Although four coupling capacitors CC are illustrated in FIG. 3, the present disclosure is not limited thereto. The coupling capacitors CC may be respectively coupled in series to the first transmission line TLP and the second transmission line TLN. The coupling capacitor CC may reduce or minimize a DC component of the data signal transmitted through the first transmission line TLP and the second transmission line TLN. Accordingly, the transmitter TX and the receiver RX can stably communicate with each other even when specifications of the transmitter TX and the receiver RX are different from each other.

The transmitter TX may transmit a reset signal BEN, a frame control signal SFC, and a lock start signal LSS to the receiver RX. In some embodiments, the transmitter TX may periodically transmit the reset signal BEN to the receiver RX according to a reset period.

In some embodiments, when the transmitter TX is powered on, the transmitter TX may transmit a data signal having a "worst" pattern (e.g., most extreme pattern) to the receiver RX. Also, the transmitter TX may transmit the lock start signal LSS to the receiver RX while the data signal is being transmitted. The worst pattern may be any one of a white pattern and a black pattern. The worst pattern will be described in detail with reference to FIG. 4B.

The receiver RX may reset an input common mode voltage VICM (see FIG. 4A) of the first transmission line TLP and the second transmission line TLN in response to the reset signal BEN. Also, in certain situations, the receiver RX may transmit a lock fail signal LFS to the transmitter TX. This will be described in detail with reference to FIG. 5.

FIG. 4A schematically illustrates a structure that may correspond to each, or either, of the first and second transmission lines TLP and TLN shown in FIG. 3.

In this specification, an input common mode voltage VICM and an input differential voltage VID may mean voltages that become a reference for determining a bit value. For example, when the input common mode voltage VICM of the first transmission line TLP is 1V and the input differential voltage VID of the first transmission line TLP is 0.5V, 1V may mean a first bit value (e.g., 1), and 0.5V may mean a second bit value (e.g., 2).

Like this, the input common mode voltage VICM and the input differential voltage VID are useful in communication between the transmitter TX and the receiver RX. However, the input common mode voltage VICM may be changed in the following case.

Referring to FIGS. 3 and 4A, each of the first and second transmission lines TLP and TLN may include a coupling capacitor CC and a receiver resistor TR between a transmitter node NTX and a receiver node NRX. For convenience of description, only one coupling capacitor CC is illustrated in FIG. 4A, but the present disclosure is not limited thereto. For example, the coupling capacitor CC may be coupled between a first node N1 and the transmitter node NTX, and the receiver resistor TR may be coupled between the first node N1 and the receiver node NRX. A voltage of the first node N1 may represent the input common mode voltage VICM.

Therefore, the input common mode voltage VICM may be calculated according to Equation 1.

$$VICM=(VTX-VRX)*(Z2)/(Z1+Z2) \quad \text{Equation 1}$$

VICM denotes an input common mode voltage, VTX denotes a voltage of the transmitter node NTX, VRX denotes a voltage of the receiver node NRX, Z1 denotes an impedance of the coupling capacitor CC, and Z2 denotes an impedance of the receiver resistor TR.

Therefore, when the frequency value of a data signal increases (e.g., when high and low level values included in the data signal are the same or are essentially the same), the input common mode voltage VICM may converge to 0. However, when the frequency value of the data signal increases (e.g., when the high and low level values included in the data signal are not the same), the input common mode voltage VICM may increase or decrease.

When the input common mode voltage VICM increases or decreases, the CDR circuit of the receiver RX may fail in synchronization (e.g., lock) of the data and clock signals of the transmitter TX. In this specification, this phenomenon is defined as a balance fail.

FIG. 4B illustrates a change in input common mode voltage VICM according to a data signal BS.

Referring to FIGS. 3 and 4B, a data period DP may include ten bit periods BP. For convenience of description, FIG. 4B illustrates that one data signal BS corresponding to the data period DP includes 10 bits corresponding to the bit periods BP, but the present disclosure is not limited thereto.

First, the timing diagram shown at the left illustrates a case where a data signal BS has a white pattern representing a white gray scale. The data signal BS having the white pattern may include nine high-level bits and one low-level bit (e.g., a reference bit AD). The reference bit AD may mean a bit arbitrarily set regardless of gray scales. As the data signal BS having the white pattern is supplied, the input common mode voltage VICM of the first transmission line TLP may increase. On the contrary, the input common mode voltage VICM of the second transmission line TLN may decrease.

Next, the timing diagram shown at the right illustrates a case where a data signal BS has a black pattern representing a black gray scale. The data signal BS having the black pattern may include one high-level bit (e.g., a reference bit AD) and nine low-level bits. As the data signal BS having the black pattern is supplied, the input common mode voltage VICM of the first transmission line TLP may decrease. On the contrary, the input common mode voltage VICM of the second transmission line TLN may increase.

As shown in FIG. 4B, when the input common mode voltage VICM increases or decreases, the CDR circuit of the receiver RX may fail in synchronization (e.g., lock) of the data and clock signals of the transmitter TX. Therefore, a balance fail may occur.

Figure 5:
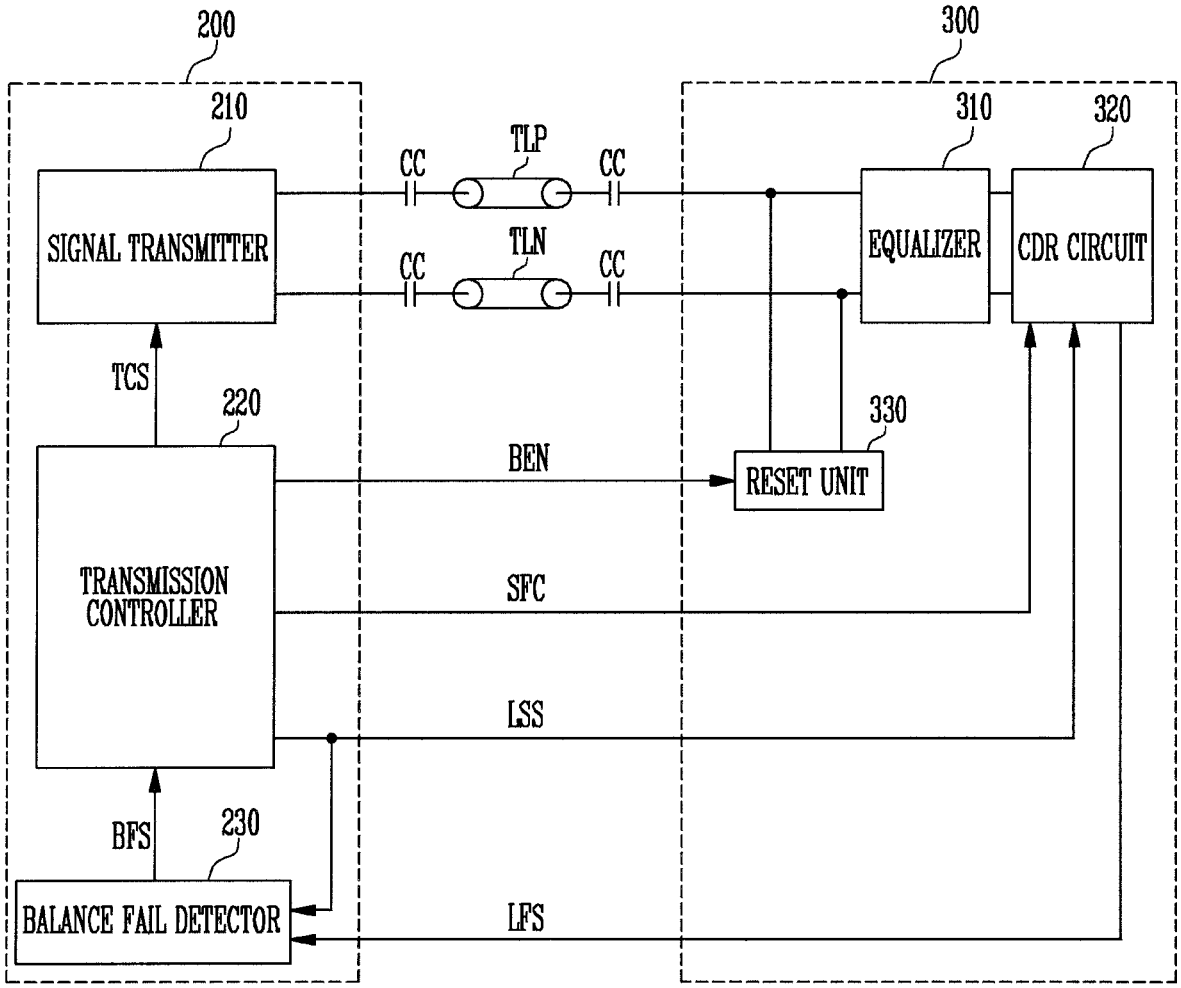
FIG. 5 is a diagram illustrating in detail the interface system according to an embodiment of the present disclosure.

FIG. 5 is a diagram illustrating in detail the interface system according to an embodiment of the present disclosure.

Referring to FIGS. 1 to 5, the transmitter TX 200 may include a signal transmitter 210, a transmission controller 220, and a balance fail detector 230.

The signal transmitter 210 may transmit a data signal corresponding to the image data RGB1 (see FIG. 1) to the receiver RX 300 through the first transmission line TLP and the second transmission line TLN. When the signal transmitter 210 receives a transmission control signal TCS, the signal transmitter 210 may transmit a data signal having a "worst" pattern to the receiver RX through the first transmission line TLP and the second transmission line TLN. For example, when the transmitter TX is powered on, the signal transmitter 210 may transmit the data signal having the worst pattern to the receiver RX. For example, the worst pattern may include the white pattern or black pattern shown in FIG. 4B.

The transmission controller 220 may transmit a rest signal BEN to the receiver RX. In some embodiments, the transmission controller 220 may periodically transmit the reset signal BEN to the receiver RX according to a reset period KBP (see FIG. 9).

In order to control a frame operation of the display device 100 (see FIG. 1), the transmission controller 220 may transmit a frame control signal SFC to the receiver RX. For example, referring to FIG. 2, the transmission controller 220 may transmit the frame control signal. SFC having a high level during the active data period, and transmit the frame control signal SFC having a low level during a portion of the vertical blank period.

While the data signal is being transmitted to the receiver RX, the transmission controller 220 may transmit a lock start signal LSS for phase lock to the receiver RX. For example, the lock start signal LSS may have a high-level voltage.

When the display device 100 (see FIG. 1) is powered on, or when a separate request is received from a user, the transmission controller 220 may transmit the transmission control signal TCS to the signal transmitter 210.

The transmission controller 220 may receive a balance fail signal BFS from the balance fail detector 230.

The transmission controller 220 may measure a balance fail time BFT (see FIG. 8), based on the balance fail signal BFS. For example, the balance fail time BFT (see FIG. 8) means a time for which the balance fail signal BFS is supplied.

The transmission controller 220 may set the reset period KBP (see FIG. 9), based on the balance fail time BFT. For example, the reset period KBP may be smaller than or equal to the balance fail time BFT. In some embodiments, the reset period KBP may be set to a value obtained by dividing K (K is a natural number larger than 1) into the balance fail time BFT. The transmission controller 220 may periodically transmit the reset signal BEN to the receiver RX for every calculated reset period KBP so as to reset the input common mode voltage VICM of each of the first transmission line TLP and the second transmission line TLN.

The balance fail detector 230 may receive a lock start signal LSS from the transmission controller 220, and may receive a lock fail signal LFS from the receiver RX. The lock start signal LSS may have a high-level voltage, and the lock fail signal LFS may have a low-level voltage.

The balance fail detector 230 may generate a balance fail signal BFS, based on the lock start signal LSS and the lock fail signal LFS. For example, the balance fail detector 230 may generate the balance fail signal BFS by performing an AND logic operation on the lock start signal LSS and the lock fail signal LFS.

The balance fail detector 230 may transmit the balance fail signal BFS to the transmission controller 220. For example, the balance fail detector 230 may transmit the balance fail signal BFS to the transmission controller 220 from the point of time when the lock start signal LSS is received to the point of time when the lock fail signal LFS is received.

The receiver RX 300 may include an equalizer 310, a CDR circuit 320, and a reset unit 330.

The equalizer 310 may remove noise included in a data signal supplied to the first transmission line TLP and the second transmission line TLN.

The CDR circuit 320 may be synchronized (e.g., phase-locked) with the transmitter TX by extracting a reference clock signal from the data signal to thereby determine a bit value of the data signal. The CDR circuit 320 may receive a frame control signal SFC. The CDR circuit 320 may operate in units of frames based on the frame control signal SFC. For example, when the frame control signal SFC having a low level is received, the CDR circuit 320 may determine that the transmitted data signal is a training data.

The CDR circuit 320 may receive a lock start signal LSS. When the lock start signal LSS is received, the CDR circuit 320 may initiate phase lock using the received data signal. When the phase lock fails, the CDR circuit 320 may transmit a lock fail signal LFS to the transmitter TX. For example, the lock fail signal LFS may have a low-level voltage. That is, when a balance fail occurs corresponding to the data signal having the worst pattern, the CDR circuit 320 may transmit the lock fail signal LFS to the transmitter TX.

The reset unit 330 may receive a reset signal BEN. The reset unit 330 may rest the input common mode voltage VICM of each of the first transmission line TLP and the second transmission line TLN as a reference voltage (e.g., a ground voltage), based on the reset signal BEN.

Figure 6:
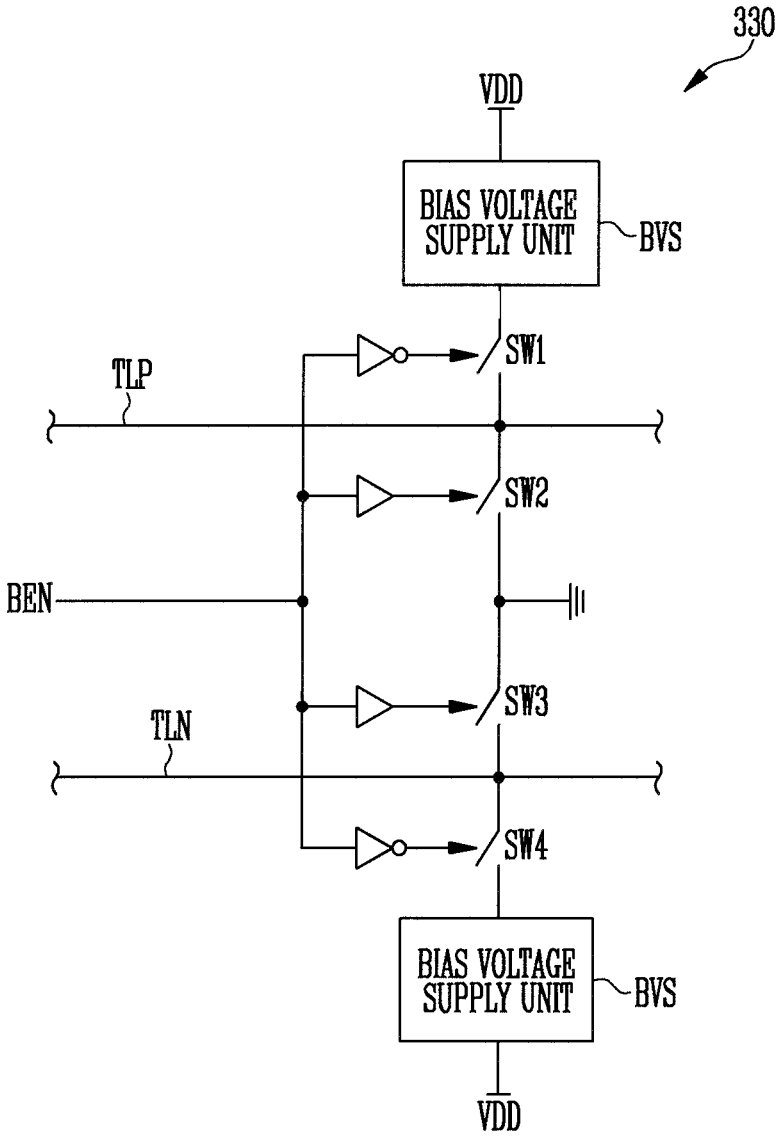
FIG. 6 is a diagram illustrating in detail a reset unit according to an embodiment of the present disclosure.

FIG. 6 is a diagram illustrating in detail the reset unit 330 according to an embodiment of the present disclosure.

Referring to FIG. 6, the reset unit 330 may include switches SW1 to SW4 and at least one bias voltage supply unit BVS coupled to a driving power source VDD.

The switches SW1 to SW4 may include a first reference switch SW2, a second reference switch SW3, a first driving switch SW1, and a second driving switch SW4.

For example, the reset signal BEN may have a high-level voltage. However, the present disclosure is not limited thereto.

The first transmission line TLP may be coupled to the first driving switch SW1 and the first reference switch SW2, and the second transmission line TLN may be coupled to the second reference switch SW3 and the second driving switch SW4.

The first reference switch SW2 is coupled between a reference power source GND and the first transmission line TLP, and may be turned on when the reset signal BEN is supplied. The second reference switch SW3 is coupled between the reference power source GND and the second transmission line TLN, and may be turned on when the reset signal BEN is supplied. The first driving switch SW1 is coupled between the bias voltage supply unit BVS and the first transmission line TLP, and may be turned on when the reset signal BEN is not supplied. The second driving switch SW4 is coupled between the bias voltage supply unit BVS and the second transmission line TLN, and may be turned on when the reset signal BEN is not supplied.

Accordingly, when the reset signal BEN is supplied to the reset unit 330, the first transmission line TLP and the second transmission line TLP may be coupled to the reference power source GND. Therefore, the first transmission line TLP and the second transmission line TLN may reset to the reference voltage (e.g., the ground voltage). Further, when the reset signal BEN is not supplied to the reset unit 330, the first transmission line TLP and the second transmission line TLN may be coupled to the bias voltage supply unit BVS, such that the first transmission line TLP and the second transmission line TLN may have a voltage according to the transmitted data signal.

Figure 7:
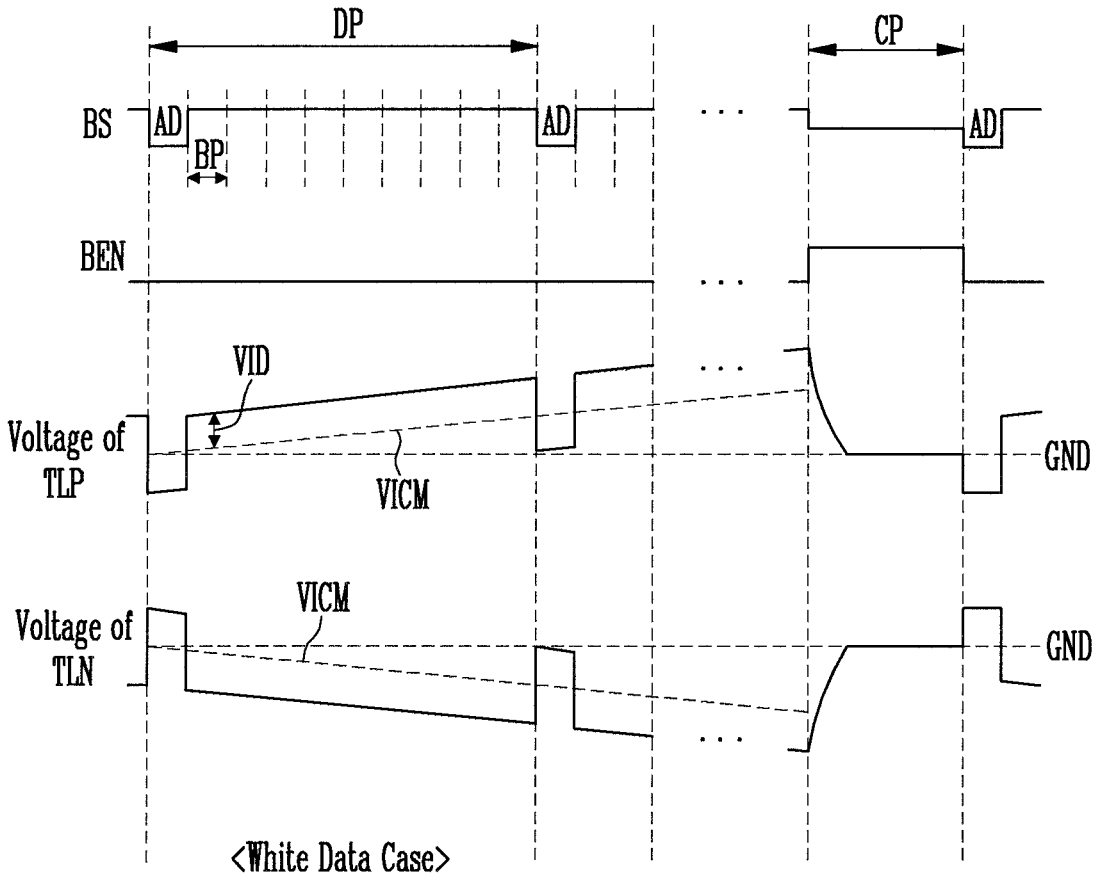
FIG. 7 is a diagram illustrating a driving method of the interface system according to an embodiment of the present disclosure.

FIG. 7 is a diagram illustrating a driving method of the interface system according to an embodiment of the present disclosure.

For convenience of description, a case where a data signal BS has a white pattern is described. However, as shown in FIG. 4B, the data signal BS may have a black pattern.

Referring to FIGS. 1 to 7, the data signal having the white pattern may include nine high-level bits and one low-level bit. As the data signal BS having the white pattern is supplied, the input common mode voltage VICM of the first transmission line TLP may increase, while the input common mode voltage VICM of the second transmission line TLN may contrarily decrease. Therefore, a balance fail may occur.

The reset signal BEN may be supplied to the reset unit 330 during a compensation period CR When the reset signal BEN is supplied to the reset unit 330 during the compensation period CP, the first transmission line TLP and the second transmission line TLN may be reset to the reference voltage (e.g., the ground voltage).

Figure 8:
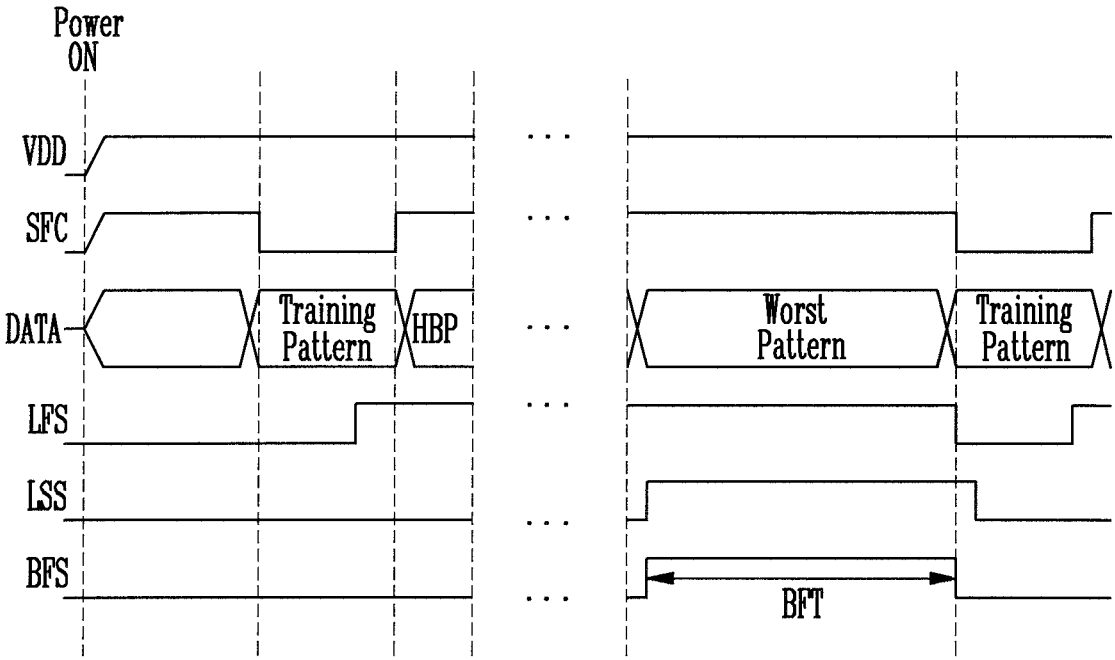
FIG. 8 is a diagram illustrating a driving method of the interface system according to an embodiment of the present disclosure.

FIG. 8 is a diagram illustrating a driving method of the interface system according to an embodiment of the present disclosure.

FIG. 8 illustrates a driving method of the interface system ITF when the display device 100 (see FIG. 1) is powered on. For example, FIG. 8 illustrates in detail a method in which the transmission controller 220 of the transmitter TX of the interface system ITF measures a balance fail time BFT.

Referring to FIGS. 1 to 8, when the display device 100 is powered on, the level of the driving power source VDD may be changed from a low level to a high level.

As shown in FIGS. 2 and 8, the frame control signal SFC may have a low level when data DATA having a training pattern is transmitted, and may have a high level when the data DATA having the training pattern is not transmitted.

The lock fail signal LFS may have a low level. When the display device 100 is powered on, the transmission controller 220 may transmit the lock fail signal LFS to the receiver RX.

When a lock success occurs in a period in which the data DATA having the training pattern is transmitted, the transmission controller 220 may not transmit the lock fail signal LFS to the receiver RX.

The signal transmitter 210 may transmit the data DATA having a worst pattern (e.g., a white pattern or black pattern) to the receiver according to the received transmission control signal TCS. Because a lock fail occurs, the transmission controller 220 may re-transmit the lock fail signal LFS to the receiver RX.

The lock start signal LSS may have a high level. When the data DATA having the worst pattern is transmitted, the transmission controller 220 may supply the lock start signal LSS to the receiver RX.

The balance fail detector 230 may receive the lock start signal LSS from the transmission controller 220, and may receive the lock fail signal LFS from the receiver RX. The balance fail detector 230 may generate a balance fail signal BFS, based on the lock start signal LSS and the lock fail signal LFS. For example, the balance fail detector 230 may generate the balance fail signal BFS by performing an AND logic operation on the lock start signal LSS and the lock fail signal LFS.

Therefore, the balance fail detector 230 may generate the balance fail signal BFS during the balance fail time BFT, and may transmit the balance fail signal BFS to the transmission controller 220. That is, the balance fail time BFT may be a time from the point of time when the lock start signal LSS is received to the point of time when the lock fail signal LFS is received. Consequently, the transmission controller 220 can measure the balance fail time BFT according to the above-described method. Also, the transmission controller 220 can set the reset period KBP based on the balance fail time BFT.

Figure 9:
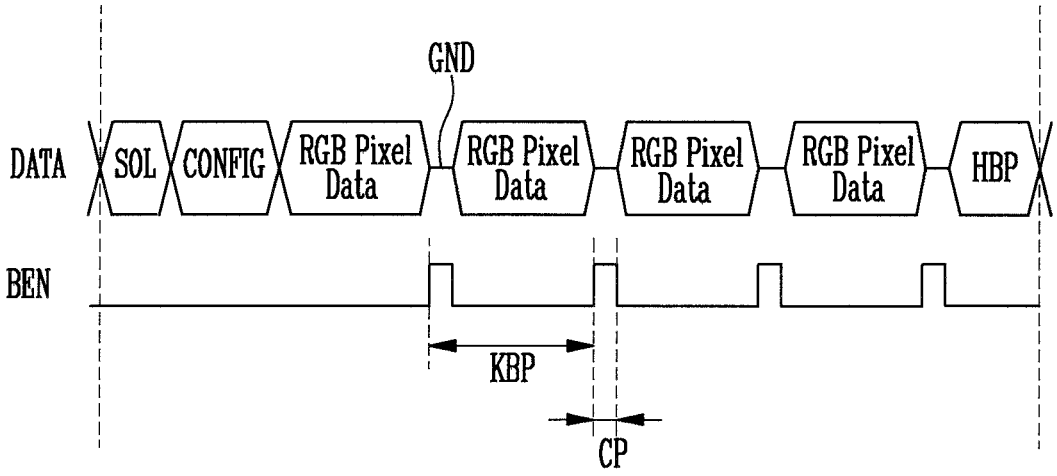
FIG. 9 is a diagram illustrating a driving method of the interface system according to an embodiment of the present disclosure.

FIG. 9 is a diagram illustrating a driving method of the interface system according to an embodiment of the present disclosure.

FIG. 9 illustrates a driving method of the interface system ITF when the display device 100 (see FIG. 1) performs a general operation. For example, FIG. 9 illustrates in detail a method in which the reset unit 330 (see FIG. 5) resets the first transmission line TLP and the second transmission line TLN for every reset period KBP.

Referring to FIGS. 1 to 9, the transmission controller 220 may transmit the reset signal BEN to the reset unit 330 of the receiver RX for every reset period KBP.

The reset unit 330 may reset the first transmission line TLP and the second transmission line TLN for every reset period KBP based on the reset signal BEN. The reset unit 330 may reset the first transmission line TLP and the second transmission line TLN for a compensation period CP. Therefore, during the compensation period, data DATA may have the reference voltage (e.g., the ground voltage) of the reference power source GND for every reset period KBP.

In the interface system and the display device including the same according to the present disclosure, the input common mode voltage of the transmitter or the receiver is periodically reset, so that communication performance can be improved.

Embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise for example indicated. Accordingly, it will be understood by those of skill in the art that various changes in form and details may be made without departing from the spirit and scope of the present disclosure as set forth in the following claims, with functional equivalents thereof to be included therein.

What is claimed is:

1. An interface system comprising a transmitter and a receiver, which are coupled to each other through transmission lines, wherein the transmitter comprises a transmission controller configured to transmit a reset signal to the receiver, wherein the receiver comprises a reset unit configured to reset input common mode voltages of the transmission lines, based on the reset signal, and wherein the transmission lines comprise a first transmission line for transmitting a signal having a first phase, and a second transmission line for transmitting a signal having a second phase that is different from the first phase.

2. The interface system of claim 1, wherein the reset unit comprises a first reference switch and a second reference switch, which are configured to be turned on when the reset signal is supplied, wherein the first reference switch is coupled between a reference power source and the first transmission line, and wherein the second reference switch is coupled between the reference power source and the second transmission line.

3. The interface system of claim 2, wherein the reference power source has a ground voltage.

4. The interface system of claim 2, wherein the reset unit comprises a bias voltage supply unit coupled between a driving power source and a first driving switch, and coupled between the driving power source and a second driving switch, the first and second driving switches being configured to be turned on when the reset signal is not supplied, wherein the first driving switch is coupled between the bias voltage supply unit and the first transmission line, and wherein the second driving switch is coupled between the bias voltage supply unit and the second transmission line.

5. The interface system of claim 1, wherein each of the first transmission line and the second transmission line comprise a coupling capacitor.

6. The interface system of claim 1, wherein the first phase and the second phase are opposite to each other.

7. The interface system of claim 1, wherein the transmission controller is configured to periodically transmit the reset signal to the receiver according to a reset period.

8. The interface system of claim 7, wherein the transmitter further comprises a signal transmitter configured to transmit a data signal having a worst pattern to the receiver when the transmitter is powered on, and wherein the transmission controller is configured to transmit a lock start signal to the receiver while the data signal is being transmitted, wherein the worst pattern is any one of a white pattern and a black pattern.

9. The interface system of claim 8, wherein the receiver further comprises a clock data recovery (CDR) circuit configured to transmit a lock fail signal to the transmitter when a balance fail occurs corresponding to the data signal.

10. The interface system of claim 9, wherein the transmitter further comprises a balance fail detector configured to generate a balance fail signal based on the lock start signal and the lock fail signal.

11. The interface system of claim 10, wherein the transmission controller is configured to measure a balance fail time representing a time for which the balance fail signal is supplied.

12. The interface system of claim 11, wherein the transmission controller is configured to set, to the reset period, a value obtained by dividing K (K is a natural number larger than 1) into the balance fail time.

13. A display device comprising:

a display unit comprising pixels arranged at crossing regions of scan lines and data lines;

a data driver configured to supply data signals to the data lines; and a timing controller configured to communicate with the data driver through an interface system, wherein the interface system comprises a transmitter and a receiver, which are coupled to each other through transmission lines, wherein the transmitter comprises a transmission controller configured to transmit a reset signal to the receiver, wherein the receiver comprises a reset unit configured to reset input common mode voltages of the transmission lines based on the reset signal, and wherein the transmission lines comprise a first transmission line for transmitting a signal having a first phase, and a second transmission line for transmitting a signal having a second phase that is different from the first phase.

14. The display device of claim 13, wherein the reset unit comprises a first reference switch and a second reference switch, which are configured to be turned on when the reset signal is supplied, wherein the first reference switch is coupled between a reference power source and the first transmission line, and wherein the second reference switch is coupled between the reference power source and the second transmission line.

15. The display device of claim 14, wherein the reset unit further comprises a bias voltage supply unit coupled between a driving power source and a first driving switch, and coupled between the driving power source and a second driving switch, the first and second driving switches being configured to be turned on when the reset signal is not supplied, wherein the first driving switch is coupled between the bias voltage supply unit and the first transmission line, and wherein the second driving switch is coupled between the bias voltage supply unit and the second transmission line.

16. The display device of claim 15, wherein the transmission controller is configured to periodically transmit the reset signal to the receiver according to a reset period.

17. The display device of claim 16, wherein the transmitter further comprises a signal transmitter configured to transmit a data signal having a worst pattern to the receiver when the transmitter is powered on, and wherein the transmission controller is configured to transmit a lock start signal to the receiver while the data signal is being transmitted wherein the worst pattern is any one of a white pattern and a black pattern.

18. The display device of claim 17, wherein the receiver further comprises a CDR circuit configured to transmit a lock fail signal to the transmitter when a balance fail occurs corresponding to the data signal.

19. The display device of claim 18, wherein the transmitter further comprises a balance fail detector configured to generate a balance fail signal based on the lock start signal and the lock fail signal, and wherein the transmission controller is configured to measure a balance fail time representing a time for which the balance fail signal is supplied, and is configured to set the reset period based on the balance fail time.

* * * * *